United States Patent [19]

Mooring

[11] 3,951,597

[45] Apr. 20, 1976

[54] METHOD OF DRY CLEANING FABRICS

[75] Inventor: Scott W. Mooring, Fort Worth, Tex.

[73] Assignee: Steamatic, Inc., Grand Prairie, Tex.

[22] Filed: Aug. 31, 1973

[21] Appl. No.: 393,344

Related U.S. Application Data

[63] Continuation-in-part of Ser. No. 206,059, Dec. 8, 1971, abandoned.

[52] U.S. Cl. ..... 8/142

[51] Int. Cl.[2] ..... D06L 1/04

[58] Field of Search ..... 8/137, 142, 149.1, 158; 15/302, 320, 321, 322, 345, 353; 252/162, 172, 171

[56] References Cited

UNITED STATES PATENTS

| | | | |
|---|---|---|---|
| 1,948,045 | 2/1934 | Parkhurst | 252/172 |
| 2,017,568 | 10/1935 | Parkhurst | 252/172 |
| 2,058,632 | 10/1936 | Riebel et al. | 8/142 |
| 2,200,026 | 5/1940 | Juelson | 15/321 |
| 2,748,084 | 5/1956 | Lew et al. | 252/172 |
| 2,922,694 | 1/1960 | Avera | 8/142 |
| 3,619,830 | 11/1971 | Harris et al. | 8/142 |
| 3,640,881 | 2/1972 | Moussalli | 252/171 |
| 3,687,729 | 8/1972 | Winburn et al. | 8/142 |
| 3,775,053 | 11/1973 | Wisdom | 15/302 |

*Primary Examiner*—Stephen C. Bentley
*Attorney, Agent, or Firm*—Bertram H. Mann

[57] ABSTRACT

A method of dry cleaning fabrics, for instance, draperies or clothing, in situ, by forcefully infusing the fabric in the open atmosphere with special fast-acting, versatile dry cleaning solvent so as to dissolve and suspend various stains and soils in the fabric, even though firmly set due to age, and promptly drawing ambient air and droplets of soil-laden solvent by suction into a closed waste and suction chamber where the soil is deposited in the form of a sludge, while the carrier air and solvent is discharged to the atmosphere. A special, highly effective, fast-acting, nonflammable and nontoxic solvent is provided.

7 Claims, 1 Drawing Figure

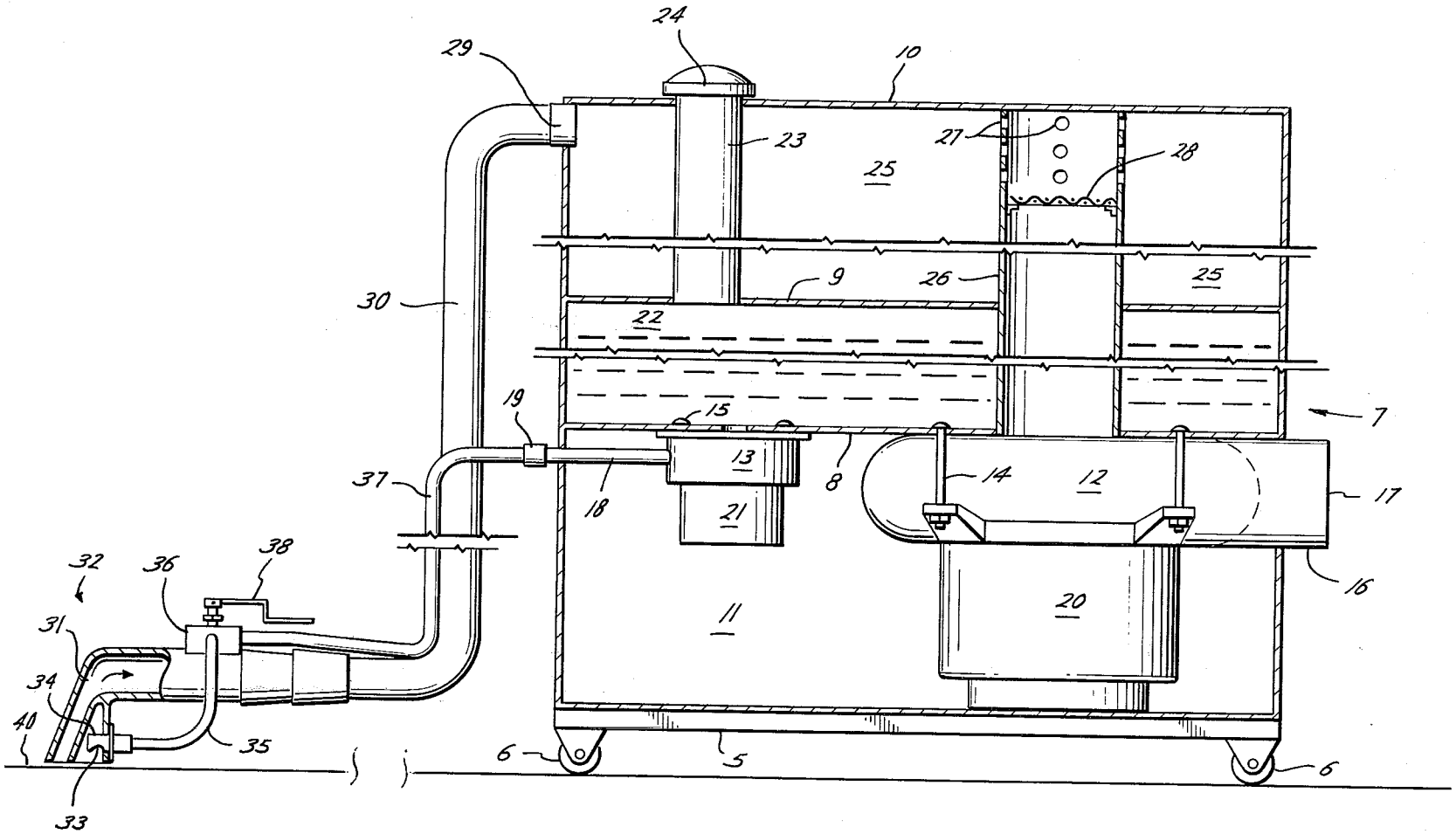
7
17
16
6
28
25
12
20
27
26
14
10
25
9
8
23
13
21
11
5
24
22
15
18
19
6
29
30
37
38
35
36
32
31
34
33
40

METHOD OF DRY CLEANING FABRICS

RELATED APPLICATION

This application is a continuation-in-part of my application Ser. No. 206,059 filed DEC. 8. 1971, now abandoned.

FIELD OF THE INVENTION

This invention relates to dry cleaning methods, particularly hand method utilizing portable apparatus for cleaning fabrics in situ.

BACKGROUND OF THE INVENTION

Various apparatuses and methods have been developed for utilizing solvents, usually hot, aqueous mixtures and/or steam, in cleaning rugs, upholstery, drapes, and the like in situ by means of hand-operated nozzles connected to the solvent supply and a suction source so as to withdraw soil-contaminated solvent from the work over which the nozzle is passed. An example of such apparatus and method is disclosed in Thompson et al. U.S. Pat. No. 3,559,220. Such devices, however, do not as effectively remove some soil as does dry cleaning equipment, require a substantial drying period, and are damaging to certain fabrics. Sixty percent of the drapery and upholstery fabrics in use now require dry cleaning, so there is a substantial unfilled demand for equipment which will dry clean such fabrics in situ.

Conventional commercial dry cleaning equipment and processes have been developed to a high degree of efficiency. However, such methods require large and expensive closed systems for recirculation and purification of large quantities of expensive and sometimes flammable and/or toxic solvents. Accordingly, conventional dry cleaning methods normally are limited to the cleaning of items which can be placed inside the cleaning vessel at the commercial establishment and, therefore, are not adapted for portability or cleaning of articles in situ. Moreover, articles such as clothing requiring dry cleaning, usually are sent to the cleaner fairly often so that the soils and stains therein are relatively fresh. However, heavy drapes and furniture normally remain in service over much longer periods of time, so that the stains and soils therein become set and, therefore, require longer and more effective cleaning methods. In a professional cleaning plant, a soiled item can be held longer in the wheeled vat or subjected successively to different solvent baths, if necessary. Thus, the dry cleaning of fabrics in situ, particularly with the use of suction-nozzle-type devices which provide a very short cleaning period and which are safe for use in the open atmosphere, have not been practically developed.

Accordingly, an object of the present invention is to provide a portable, compact, economical, safe, and highly efficient method of dry cleaning of fabrics in situ which is sufficiently uncomplicated for use by nonprofessionals, if desired.

A more specific object is to provide a method of dry cleaning of fabrics utilizing a novel, highly efficient solvent which is safe to use in the open atmosphere and without recirculation.

SUMMARY OF THE INVENTION

These objects and others are achieved by the methods herein disclosed and claimed which involve the forceful spraying of solvent against the fabric being cleaned for dissolution and suspension of soils therein, prompt drawing of the soil-laden solvent and ambient air through and around the fabric, deposition of the entrained soil in the suction chamber, and discharge of the soil-entraining air and atomized solvent into the atmosphere. Because of extremely rapid transfer of the solvent from the spray nozzle against the fabric and into the suction inlet, a solvent of high solvency and well-controlled violatility is used which, under the operating conditions, is nonflammable and nontoxic to persons in the vicinity. Sufficient suction is provided to thoroughly agitate the fabric while remaining in liquid droplet form to pick up the maximum soil in the extremely short time during exposure of the fabric to the solvent and carry the soil into the separating chamber. Finally, a mixture of solvents is preferred, for instance, a major ingredient of chlorinated hydrocarbon in combination with lesser proportions of an aliphatic-compound and a detergent capable of readily dissolving water soluble soils and stains. The aliphatic and detergent ingredients serve not only their distinctive cleaning functions but also serve to reduce the cost of the solvent. The less expensive aliphatic ingredient, if used alone, would be highly flammable, but in the carefully controlled proportions, as specified, its flammability is entirely suppressed by the blanket of chlorinated solvent. Moreover, slight toxicity of the chlorinated ingredient is entirely suppressed by the aliphatic compound.

BRIEF DESCRIPTION OF THE DRAWING

The FIGURE is a schematic vertical longitudinal sectional view of an exemplary apparatus for practicing the method.

DETAIL DESCRIPTION OF THE DRAWING

The appartus comprises a chassis 5 mounted on wheels or casters 6 for easy portability. Resting on the chassis is the housing, generally designated 7, which may be cylindrical, compact, and leakproof, on the order, conveniently, of 21 inches in height and 16 inches in diameter. The housing is traversed intermediately by vertically spaced horizontal walls 8 and 9 and at the top is provided with a top wall or cover 10. If desired, an additional compartment may be provided, for instance, above top wall 10, for storage of the nozzle hose. Bottom chamber 11 between chassis 5 and horizontal wall 8 is an equipment chamber for accommodating vacuum pump or blower 12 and liquid solvent pump 13, both supported from transverse wall 8 by bolts as shown at 14 and 15. Access may be had to chamber 11 through the open bottom of housing 7 when lifted from the chassis. The exhaust pipe 16 of suction blower 12 discharges through casing 7, as at 17. The outlet 18 of solvent pump 13 also extends through casing 7 and terminates in a fitting 19. Blower 12 and pump 13 are shown powered by motors 20 and 21 having energizing wire terminals (not shown).

Between the intermediate transverse walls 8 and 9 is a fluid-tight area 22 for storage of a quantity of liquid solvent. A filler pipe 23 extends upwardly from wall 9 through cover wall 10 and is provided with a closure cap 24. The top chamber 25 between transverse walls 9 and 10 is normally sealed and constitutes the suction and waste chamber. This chamber will be provided with a cleanout opening (not shown) as by removal of top wall 10 which, of course, would be suitably sealed when closed. The inlet of suction blower 12 is connected to chamber 25 by a pipe 26 extending through intermediate transverse walls 8 and 9 and terminating adjacent the undersurface of top wall 10. The upper portion of pipe 26 is provided with inlet ports 27 beneath which there is provided a filter screen 28. A suction connection 29 in casing portion 25 near the top thereof connects by means of a flexible hose 30 with a first inlet chamber 31 in a hand nozzle, generally designated 32. A second chamber 33, adjacent passage 31, mounts a solvent discharge nozzle 34 connected by a pipe 35 to a valve housing 36. Also connected to this housing is the solvent duct 37 which connects with fitting 19 and thence through liquid pump 13 with solvent reservoir 22. The supply of solvent through housing 36 is controlled by a valve and hand-operated valve lever 38. Solvent pump 13 must have sufficient capacity in relation to solvent feed duct 37 and nozzle 34 to direct the solvent forcibly into the soiled fabric 40 confronting the outlet of solvent discharge nozzle 34.

In an exemplary embodiment a positive pressure pump operating at 1750 RPM and delivering solvent at 10 P.S.I.G. was found satisfactory to properly infuse the fabric. The spray nozzle used had a single orifice of 0.035 inch diameter. The resultant solvent jet proved adequate in delivery force, agitation, and spray pattern to provide the necessary quick cleaning pattern. However, any solvent delivery pressure from 0.5 to 500 P.S.I.G. and solvent delivery volume from 0.001 to 10 G.P.M. might be utilized in connection with different duct and orifice sizes and designs.

The suction pump used was of a capacity to produce a free air flow of 100 c.f.m. through a two-inch orifice. This flow rate, of course, was reduced at the inlet of nozzle chamber 31 due to the resistance of hose 30 and the hand nozzle. It was estimated that the actual flow of air across chamber 33 and through and across the work fabric and into suction nozzle 31 was on the order of 55 c.f.m. at an air velocity at the nozzle of approximately 100 feet per second. This velocity and volume of air movement, while in excess of minimum requirements, permitted deeper penetration within the fabric and far better cleaning at the surface.

The discharge of solvent from nozzle 34 should be in the form of a fairly compact spray of fine droplets which, because of the degree of volatility of the solvent used, are carried by the air stream, together with dissolved or absorbed and suspended soil from the fabric, into suction chamber 25. This characteristic of the solvent is important in holding the soil in suspension and solution in passage into the vacuum and waste chamber. At the same time, the degree of volatility of the solvent also insures substantially complete evaporation thereof upon entering the enlarged suction and waste chamber. The resultant vapors are drawn through ports 27 and filter screen 28 where residual liquids and solids are separated from the air and evaporated solvent. These vapor and gaseous constituents then are discharged through blower outlet 17 into the atmosphere. During a moderate use of the apparatus, if the room is of fair size, no special discharging piping need be used. For instance, only a short period of use would be required in removing a spot from a man's suit or coat or other fabric. On the other hand, where regular use of the apparatus during longer periods of time is contemplated, vapor discharge 17 may be connected by suitable piping to the exterior air, as through a suitable vent pipe.

The characteristics of the cleaning solvent are particularly important, in fact critical, due to the fact that multiple varieties of stains and soils must be attacked by rapid exposure of the fabric to the solvent spray and air stream through and across the fabric induced by the suction nozzle. It must soften or dissolve the binder holding the soil in the fabric and it must disperse the undissolved solids to facilitate their removal from the fabric. Also, the solids must be prevented from redepositing in the fabric and these actions must be performed in the split second following impingement of the fabric by the solvent. Of course, it is essential for domestic use of such method and apparatus that the solvent be nonflammable and nontoxic as well as inexpensive. Finally, any solvent remaining in the fabric should evaporate quickly.

The cleaning power of the solvent is measured in Kauri Butanol (K.B.) value - A.S.T.M. Method D1133-61. Many solvents were potentially usable and many were tried. Some were rejected as too easily flammable as the predominant ingredient or highly toxic, as benzene; others, as ketones and esters, were known to attack certain fabrics such as rayon; and pine-derived solvents were not sufficiently volatile. Certain chlorinated hydrocarbons used by commercial dry cleaners, as carbon tetrachloride, ethylene dichloride, propylene dichloride, and monochlorobenzene, were rejected as being too toxic for use in an open air, noncirculating system of the present type.

From the list of chlorinated hydrocarbons tried, the most suitable for the purpose appeared to be methylene chloride, trichloroethylene, 1,1,1 trichloroethane, perchloroethylene, methyl chloroform, and methylene chloride. Of these, the most satisfactory for use in the present method was trichloroethylene. This product has an evaporation rate (compared to 100 for carbon tetrachloride) of 84, a toxicity MAC value of 200, a K.B. value of 130, and is nonflammable. However, this and other such chlorinated hydrocarbons, while effective solvents, particularly for semisolid and solid greases and exemplary from the point of view of flammability and toxicity, are not very effective in removing water-deposited soils, for instance, coffee stains. Moreover, they are relatively expensive.

Accordingly, to make the solvent more efficient, versatile, and less expensive, while retaining the nontoxic , non-flammable properties, a light petroleum fraction, with the following characteristics is added in proportions of approximately 2 to 30 percent of the ultimate volume of the solvent. The petroleum fraction should have an evaporation rate closely similar to that of the chlorinated solvent used so that the petroleum fraction will remain wholly blanketed by the chlorinated major ingredient in the jet spray whereby flammability and toxicity of the former are entirely suppressed by the latter. Certain aliphatic compounds were found to be suitable for this purpose, in particular, hexane, heptane, octane, and nonane, although other light petroleum fractions, either natural or synthetic, with the following characteristics are suitable: x

| | |
|---|---|
| Molecular Weight | 97 – 257 |
| K B | 30.2 – 46.5 |
| Viscosity | .49 – .71 cps at 20°F |
| Spot Dry Time | 18 sec. – 1 min. 23 sec. at normal room temp. (or approximately same as chlorinated ingredient) |

-continued

Chemically Neutral

Such latter ingredient is more effective than the chlorinated ingredient for removing certain light greases, oils, fats, and oxidized binders as well as water soluble soils and also is miscible with any moisture which may be present. Furthermore, the aliphatic or like ingredient is substantially less expensive than chlorinated hydrocarbons and has the property of lubricity which allows the fibers to slide over one another to facilitate extraction of entrapped soils, which have penetrated the fibers, by crimping the fabric at the nozzle. This characteristic also permits twisting and blending of the fibers without fracture thereof and also has the faculty of inhibiting formation of static during the process. Finally, the aliphatic ingredient tends to suppress the slight toxicity of the chlorinated hydrocarbons, while the major chlorinated ingredient suppresses the flammability of the aliphatic.

A third desirable, but not essential ingredient is a nonaqueous detergent especially for removing water-soluble stains and soils. Many substances known to chemists and solvent experts are available for use in small proportions, 1 percent by volume or less of the final blend. One such detergent blend used successfully is an oil-soluble petroleum sulfonate and sulphosuccinate with an average molecular weight of 450 units. This ingredient, if increased to approximately 5 percent by volume, may entirely substitute for the petroleum fraction, but this is not preferred, due to the greater cost of the resultant solvent. The word detergent as used herein refers to such nonaqueous, non hydrocarbon material capable of dissolving or emulsifying water soluble solids and itself soluble or miscible in the remainder of the solvent mixture.

In addition, certain other optional ingredients in minute quantities may be added for various purposes, such as agents for improving emulsification, stabilization, deodorization, and optical brightening. An exemplary formulation of detergent additives to the basic chlorinated hydrocarbons alone or mixed with an aliphatic is as follows:

1. An oil-soluble petroleum sulfonate and sulfosuccinate (average molecular weight 450 units to improve detergency of the blend).

2. A polyethoxylated phenolic nonionic emulsifier (adds water emulsification and water soluble dispersability).

(Additives 1 and 2 to total not more than 0.2 - 0.6 percent by volume.)

A desirable stablizing additive is as follows:

3. Ethanolamines (prevent decomposition of chlorinated solvents due to moisture or heat or neutralize the decomposition compounds).

The described blend of ingredients makes it possible to remove many water-deposited soils and stains without the addition of water, and to attack the heaviest of asphalts with the same solvent. Of course, the novel method is well-adapted for the cleaning of drapes, furniture upholstery, and like fabrics without the necessity of removing the items to a cleaning plant and without damage to the work or any danger to the operator or other occupants of the area around the item being cleaned.

The solids and nonevaporated liquids discharged into chamber 25 collect as a sludge on the bottom of the chamber and may be washed out or otherwise removed form time to time. Because of its simplicity, the apparatus and method are well-adapted for use by nonprofessionals and within inhabited areas. Even though the spent solvent exhaust from outlet 16 is piped outside, a certain small quantity of the solvent will inevitably escape into the atmosphere so that nontoxicity and nonflammability are imperative. The novel process, emphasizing volatility and rapid cleaning properties of the solvent, is diametrically opposite to the emphasis in the commercial dry cleaning industy where large quantities of solvent are repeatedly utilized in closed systems with various distilling and other purifying features to avoid wastage of the solvent. On the contrary, the present applicant contemplates the use of relatively small quantities of a quite volatile ingredient mixture in an open and noncirculating system wherein the cleaning action takes place in a fraction of a second. This is a basically new concept and may be applied with the use of various apparatus features.

Accordingly, the invention may be modified in various respects as will occur to those skilled in the art, and the exclusive use of all modifications as come within the scope of the appended claims is contemplated.

I claim:

1. The method of dry cleaning fabrics, as upholstery, draperies and the like, in situ, the method being suitable for normal use in or near inhabited areas without recapture of spent solvent, which comprises the steps of a. placing the inlet nozzle of a suction pipe in close proximity with the fabric, b. forcefully and continuously discharging against the fabric portion immediately adjacent said inlet nozzle a spray of solvent comprising predominantly a chlorinated hydrocarbon selected from the group consisting of trichloroethylene, trichloroethane, perchloroethylene, methylene chloride, and methyl chloroform, c. immediately thereafter and continuously applying to said fabric portion through said pipe and nozzle suction sufficient to draw the sprayed solvent with entrained soil and ambient atmosphere through and from the fabric and in a stream through said nozzle and pipe, d. the velocity of the applied solvent spray and the intensity of the applied suction interacting to entrain soil in the fabric and maintain the solvent in said stream substantially in liquid droplet form for efficient transport of soil therewith, e. vaporizing said stream upon emergence from said pipe for separating and collecting the entrained soil, and f. discharging the residual solvent and air into the ambient atmosphere.

2. The method described in claim 1 in which said chlorinated hydrocarbon comprises at least between approximately 70% and 98% by volume of the solvent.

3. The method described in claim 1 in which said solvent comprises essentially two main ingredients, the first being said chlorinated hydrocarbon and constituting at least about 70% by volume of the solvent and the other being an aliphatic compound comprising not more than about 30% by volume of the solvent and having the following characteristics:

| | |
|---|---|
| Molecular Weight | 97 – 257 |
| K B | 30.2 – 46.5 |

-continued

| | |
|---|---|
| Viscosity | .49 – .71 cps at 20° F |
| Spot Dry Time | 18 sec. – 1 min. 23 sec. at normal room temp. (or approximately same as chlorinated ingredient) |
| Chemically Neutral. | |

4. The method described in claim 3 in which said aliphatic compound is selected from the group consisting of hexane, heptane, octane, and nonane.

5. The method described in claim 1 in which the solvent is comprised essentially of at least about 30% by volume of an aliphatic compound and a nonaqueous detergent capable of dissolving water soluble soils and stains.

6. The method described in claim 5 in which said aliphatic compound is selected from the group consisting of hexane, heptane, octane, and nonane.

7. The method described in claim 5 in which said detergent consists of 0.2 – 0.6 percent by volume of a blend of an oil-soluble petroleum sulfonate and sulfosuccinate with an average molecular weight of 450 units and a polyethoxylated phenolic nonionic emulsifier.

* * * * *